US009629426B1

(12) United States Patent
Dai

(10) Patent No.: US 9,629,426 B1
(45) Date of Patent: Apr. 25, 2017

(54) RIB STRUCTURE OF AN INVERSE FOLDING UMBRELLA

(71) Applicant: Jenny Fan, Bradley, IL (US)

(72) Inventor: Jenhao Dai, Taipei (TW)

(73) Assignee: Jenny Fan, Bradley, IL (US)

( * ) Notice: Subject to any disclaimer, the term of this patent is extended or adjusted under 35 U.S.C. 154(b) by 0 days.

(21) Appl. No.: 15/145,805

(22) Filed: May 4, 2016

(30) Foreign Application Priority Data

Mar. 4, 2016 (TW) ..... 105203058 U

(51) Int. Cl.
*A45B 19/10* (2006.01)
*A45B 25/02* (2006.01)
*A45B 19/00* (2006.01)

(52) U.S. Cl.
CPC ..... *A45B 19/10* (2013.01); *A45B 25/02* (2013.01); *A45B 2019/008* (2013.01)

(58) Field of Classification Search
CPC .... A45B 19/10; A45B 25/02; A45B 2019/008
USPC ..... 135/25.3, 25.31
See application file for complete search history.

(56) References Cited

U.S. PATENT DOCUMENTS 954,357 A * 4/1910 Susemihl et al. ..... A45B 19/10 135/25.31
1,249,007 A * 12/1917 Block ..... A45B 19/10 135/16
1,353,234 A * 9/1920 Gustafson ..... A45B 19/10 135/25.31
1,908,453 A * 5/1933 Schmidt ..... A45B 19/10 135/22
1,964,292 A * 6/1934 Livingston ..... A45B 19/10 135/25.31
2,616,439 A * 11/1952 Thompson ..... A45B 19/10 135/25.31
2,649,103 A * 8/1953 Militano ..... A45B 19/10 135/25.31
2,711,182 A * 6/1955 Kiel ..... A45B 19/10 135/25.31
3,457,931 A * 7/1969 Shimizu ..... A45B 19/10 135/25.3
3,732,882 A * 5/1973 Kida ..... A45B 19/10 135/25.33
3,853,135 A * 12/1974 Schafer ..... A45B 19/10 135/25.3
3,902,514 A * 9/1975 Weber ..... A45B 19/10 135/25.3

(Continued)

*Primary Examiner* — Noah Chandler Hawk

(57) ABSTRACT

A rib structure of an inverse folding umbrella includes an umbrella pole assembly and a plurality of umbrella rib components; the umbrella pole component including an umbrella pole a first umbrella receptacle and a second umbrella receptacle, the first and second umbrella receptacles; the umbrella rib component including a first bar, a connecting piece, a tail bead, a first pivot connecting base, a movable pivot, connecting base, the movable pivot connecting base between the third bar and the fourth bar, which makes the third bar and the fourth bar connected to each other and drive each other to move, and relieve the wind resistance upon the second bar, such that the second bar will not distort easily and can be kept in good condition after a long time of use, and the strength of the whole umbrella rib structure is greatly enhanced.

7 Claims, 5 Drawing Sheets

(56) References Cited

U.S. PATENT DOCUMENTS

| | | | | | |
|---|---|---|---|---|---|
| 4,007,753 | A * | 2/1977 | DeMarco | A45B 19/10 | 135/25.33 |
| 4,030,515 | A * | 6/1977 | Weber | A45B 19/00 | 135/25.3 |
| 4,105,039 | A * | 8/1978 | Schultes | A45B 19/10 | 135/25.33 |
| 4,674,524 | A * | 6/1987 | DeMarco | A45B 23/00 | 135/26 |
| 4,884,586 | A * | 12/1989 | Szu | A45B 25/02 | 135/25.34 |
| 4,984,599 | A * | 1/1991 | Hwang | A45B 19/10 | 135/25.3 |
| 5,909,746 | A * | 6/1999 | Doster | A45B 19/10 | 135/25.1 |
| 6,058,952 | A * | 5/2000 | Lin | A45B 25/22 | 135/23 |
| 9,486,044 | B1 * | 11/2016 | Dai | A45B 25/22 | |
| 2004/0211451 | A1 * | 10/2004 | Goh | A45B 25/20 | 135/31 |
| 2015/0265013 | A1 * | 9/2015 | Jenan | A45B 19/00 | 135/28 |

* cited by examiner

RIB STRUCTURE OF AN INVERSE FOLDING UMBRELLA

FIELD OF THE INVENTION

The present invention is relates to a rib structure an inverse folding umbrella.

BACKGROUND OF THE INVENTION

A prior-art rib structure of an inverse folding umbrella was disclosed in China Patent No. 201521114719.4—"A Rib Component for Straight-rib Inverse Folding Umbrellas". This patent made some improvements in the rib structure of a conventional inverse folding umbrella. However, in actual operations, some problems were found: in the aforementioned patent, at the pivot joint between the second bar and fourth bar, the connection is realized through a movable pivot connecting base. Because the second bar supports the whole outside umbrella fabric and it is also the main part subject to maximum wind resistance, the pivot point formed between the second bar and fourth bar is critic. In the aforementioned patent, as the connection is realized through a movable pivot connecting base, when, encountering strong gusts of wind, the second bar will easily bend, break or distort.

Thus, to overcome the aforementioned problems of the prior art, it would be an advancement in the present invention to provide an improved structure which can significantly improve the efficacy.

Therefore, the inventor has provided the present invention of practicability after deliberate design and evaluation based on years of experience the production, development and design related products.

SUMMARY OF INVENTION

The purpose of the present invention is to provide a rib structure of an inverse folding umbrella that improves the strength of the rib structure, thereby solving distortion or damage of the prior art.

For solving the above-mentioned problems, the technical scheme is to provide a rib structure of an inverse folding umbrella, comprising:

an umbrella pole assembly (1) and a plurality of umbrella rib components (2);

the umbrella pole component (1) comprising an umbrella pole (11), a first umbrella receptacle (12) and a second umbrella receptacle (13), the first and second umbrella receptacles (12, 13) being respectively sleeved on the umbrella pole (11);

the umbrella rib component (2) comprising a first bar (21), a second bar (22), a third bar (23) and a fourth bar (24), one end of the first bar (21) being pivoted on the first umbrella receptacle (12), the other end thereof having a connecting piece (25), one end of the second bar (22) being pivoted on the connecting piece (25), the other end configured with a tail bead (3), and the second bar (22) sleeved with a first pivot connecting base (26), one end of the third bar (23) being pivoted on the second umbrella receptacle (13), the other end being pivoted on a second pivot connecting base (27) sleeved on the first bar (21), and the third bar (23) having a third pivot connecting base (28) sleeved thereon, a movable pivot connecting base (29) and a positioning piece (291) to limit the movable pivot connecting base (29), one end of the fourth bar (24) being pivoted on the movable pivot connecting base (29), the other end is pivoted on the first pivot connecting base (26), and the fourth bar (24) having a guiding piece (4) disposed thereon and connected with the connecting piece (25), the guiding piece (4) and the first bar (21) having a flexible spring (5) disposed and configured to connect therebetween.

More specifically, wherein the umbrella pole assembly (1) further comprises a third umbrella receptacle (14) sleeved on the umbrella pole (11), the third umbrella receptacle (14) and the second umbrella receptacle (13) having a spring (6) disposed therebetween, a top end of the spring (6) pushing against a bottom of the second umbrella receptacle (13), and a bottom end pushing against a top of the third umbrella receptacle (14).

More specifically, wherein the umbrella rib components (2) further comprises a fifth bar (7), one end of the fifth bar (7) being connected on the third umbrella receptacle (14), and the other end being connected on the third pivot connecting base (28).

More specifically, wherein the third umbrella receptacle (14) has threads (141) arranged on an external surface thereof, and the third umbrella receptacle (14) is further comprises a threaded cap (8) compatible with the threads (141).

More specifically, wherein the tail bead (3) further comprises a first fixing piece (31) connected to one end of the second bar (22), and a second fixing piece (32) connected to the first fixing piece (31).

More specifically, wherein the first fixing piece (31) is further configured with an intersecting hole (311) disposed at one side thereof.

More specifically, wherein the second fixing piece (32) is further configured with a through hole (321) disposed at one side thereof.

Compared to the prior art, the advantages of the present invention uses the rib structure of the prior art, only change the movable pivot connecting base of the pivot joint of the second bar and the fourth bar to a fixed one, and install the movable pivot connecting base between the third bar and the fourth bar, which makes the third bar and the fourth bar connected to each other and drive each other to move, and relieve the wind resistance upon the second bar. Thus, the second bar will not distort easily and can be kept in good condition after a long time of use. Hence, the strength of the whole umbrella rib structure is greatly enhanced.

DETAILED DESCRIPTION OF THE PREFERRED EMBODIMENTS

Figure 1:
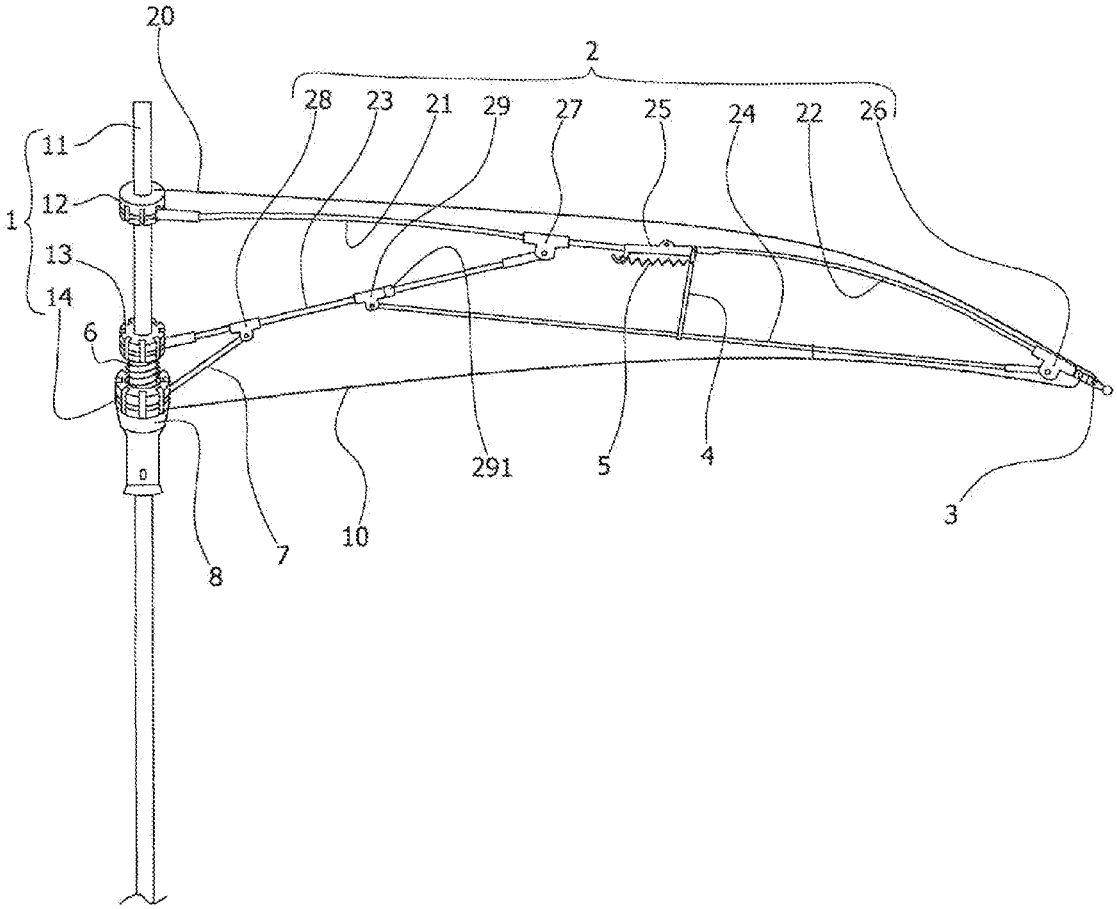
FIG. 1 is a schematic view when an a rib structure of an inverse folding umbrella of the present invention is unfolded.
Figure 2:
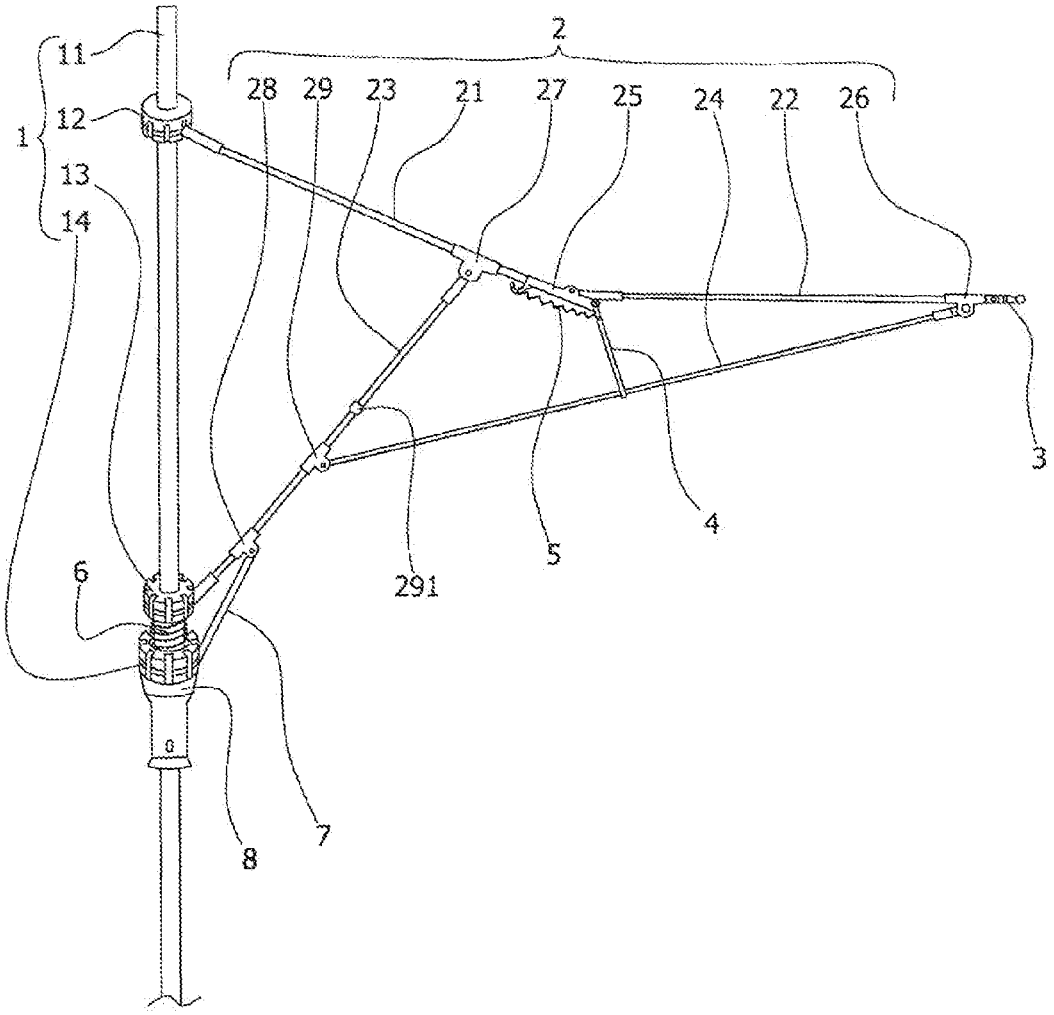
FIG. 2 is a schematic view when the rib structure of the inverse folding umbrella of the present invention is in half-folded status.
Figure 3:
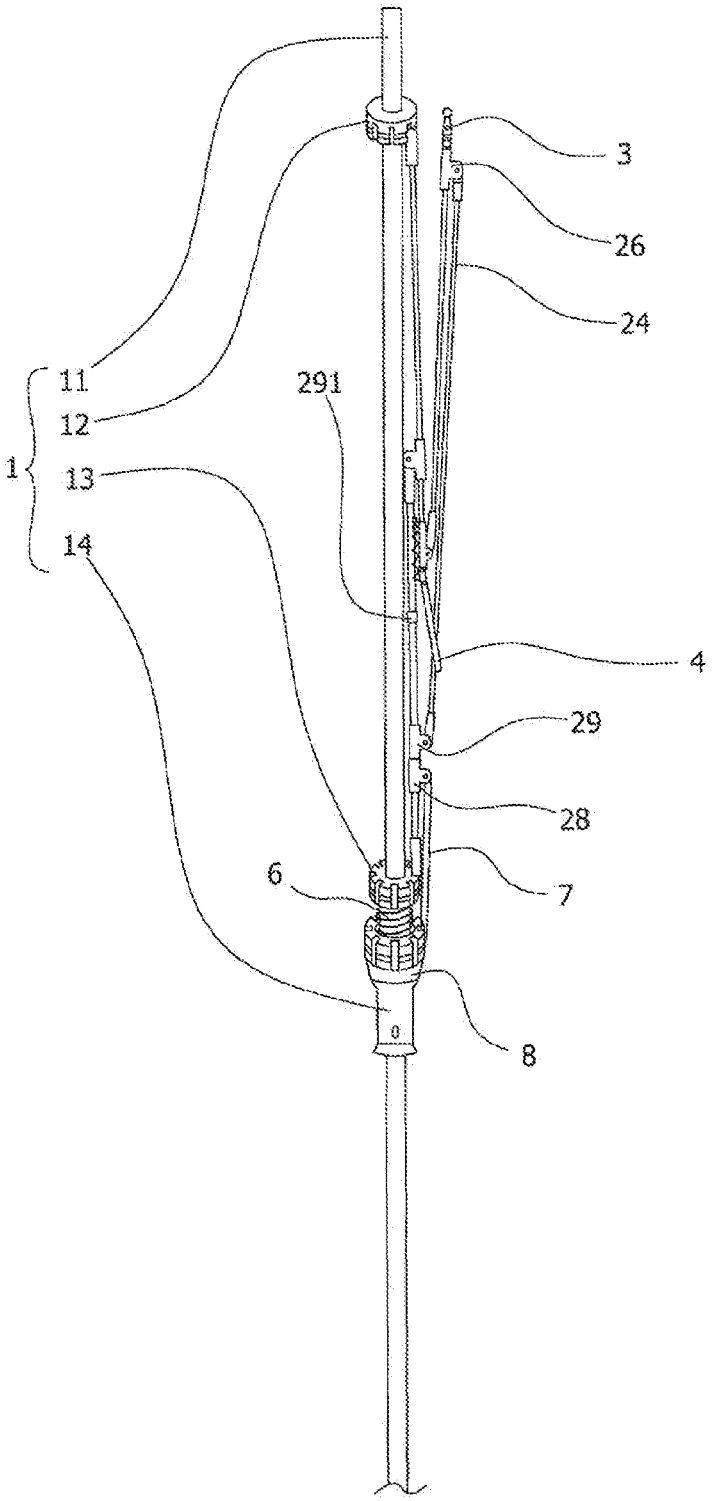
FIG. 3 is a schematic view when the rib structure of the inverse folding umbrella is folded.
Figure 4:
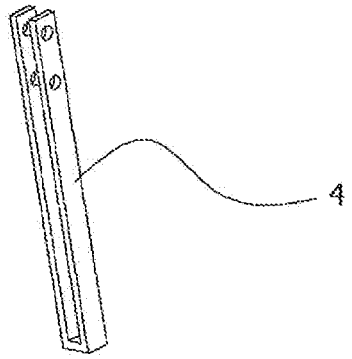
FIG. 4 is a schematic view ala guiding piece of the present invention.
Figure 5:
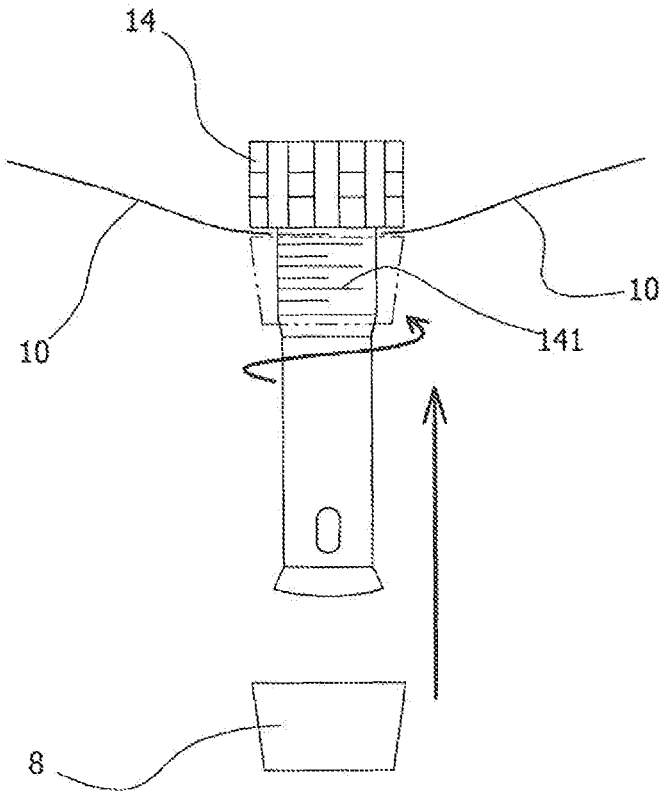
FIG. 5 is a schematic view showing a third umbrella receptacle installed on a threaded cap.
Figure 6:
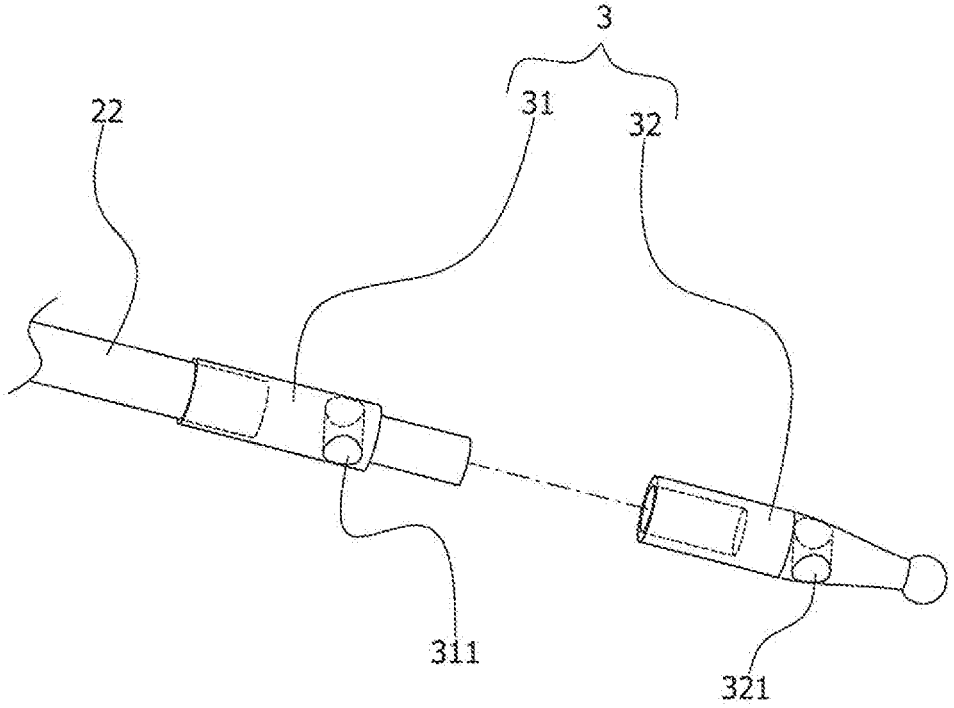
FIG. 6 is an exploded view of a tail bead of the present invention.

FIGS. 1~6 disclose a rib structure of an inverse folding umbrella, which comprises: an umbrella pole component (1)

and a plurality of umbrella rib components (2); said umbrella pole component (1) includes an umbrella pole (11), a first umbrella receptacle (12) and a second umbrella receptacle (13), said first and second umbrella receptacles (12, 13) are respectively sleeved on the umbrella pole (11); said umbrella rib component (2) includes a first bar (21), a second bar (22), a third bar (23) and a fourth bar (24), one end of the first bar (21) is pivoted on the first umbrella receptacle (12), the other end is provided with a connecting piece (25), one end of the second bar (22) is pivoted on the connecting piece (25), the other end is configured with tail bead (3), and the second bar (22) is sleeved with a first pivot connecting base (26), one end of the third bar (23) is pivoted on the second umbrella receptacle (13), the other end is pivoted on the second pivot connecting base (27) sleeved on the first bar (21), and the body of the third bar (23) is provided with a third pivot connecting base (28), a movable pivot, connecting base (29) and a positioning piece (291) to limit the movable pivot connecting base (29), one end of the fourth bar (24) is pivoted on the movable pivot connecting base (29), the other end is pivoted on the first pivot connecting base (26), and the body of the fourth bar (24) is provided with a guiding piece (4) that is pivoted on the connecting piece (25), between the guiding piece (4) and the first bar (21), a flexible spring (5) is configured to connect them together.

More specifically, through the design of the lovable pivot connecting base (29) on the third bar (23), the third bar (23) and the fourth bar (24) are connected to each other and will drive each other, to move, and relieve the wind resistance upon the second bar (22). Thus, the second bar (22) will not distort easily and can be kept in good condition after a long time of use. Hence, the strength of the whole umbrella rib structure is greatly enhanced.

Moreover, the umbrella pole component (2) further comprises a third umbrella receptacle (14) sleeved on the umbrella pole (2). Between the third umbrella receptacle (14) and the second umbrella receptacle (13), a spring (6) is configured. The top end of the spring (6) pushes against the bottom of the second umbrella receptacle (13), and its bottom end pushes against the top of the third umbrella receptacle (14). And the umbrella rib components (2) further includes a fifth bar (7). One end of the fifth bar (7) is pivoted on the third umbrella receptacle (14), whale the other end is, pivoted on the third pivot connecting base (28).

More specifically, by sliding the third umbrella receptacle (14) up and down, it will drive the fifth bar (7), and the fifth bar (push the third bar (23), an the third bar (23) will unfold the fourth bar (24) through the movable pivot connecting base (29), and subsequently unfold the first and second bars (21, 22) to open the umbrella. Based on this, when folding or unfolding the inverse folding umbrella, the third umbrella receptacle (14) and the fifth bar (7) can provide an assistance, so that the inverse folding umbrella can be folded or unfolded smoothly.

In the above structure, the external surface of said third umbrella receptacle (14) has threads (141), and the third umbrella receptacle (14) is further provided with a threaded cap (8) that matches the threads (141). Based on this, the threaded cap (8) can fasten the edge of the inner fabric (10) of the inverse folding umbrella to further intensify the fixation of the inner fabric (10), so that the edge of the inner fabric (10) will not expose outside or have loose threads.

In the above structure, said tail bead (3) further includes: a first fixing piece (31) that is connected to one end of the second bar (22), and a second fixing piece (32) that is connected to the first fixing piece (31). One side of the first fixing piece (31) is further configured with an intersecting hole (311), and one side of the second fixing piece (32) is further configured with a through hole (321).

Specifically, by adopting the tail bead (3), the inner and outside umbrella fabrics (100, 200) of the inverse folding umbrella are respectively fixed on the second bar (22) to enhance the strength and wind resistance of the inverse folding umbrella.

Secondly, through combined application of the inner and outside umbrella fabrics (100, 200), the umbrella rib components (2) can be hidden between the inner and outside umbrella fabric (100, 200), so the inverse folding umbrella has better appearance while having higher strength. Such a design can greatly promote the consumers' willingness to buy and will meet the market demand.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A rib structure of an inverse folding umbrella, comprising:

an umbrella pole assembly (1) and a plurality of umbrella rib components (2);

the umbrella pole component (1) comprising an umbrella pole (11), a first umbrella receptacle (12) and a second umbrella receptacle (13), the first and second umbrella receptacles (12, 13) being respectively sleeved on the umbrella pole (11);

the umbrella rib component (2) comprising a first bar (21), a second bar (22), a thud bar (23) and a fourth bar (24), one end of the first bar (21) being pivoted on the first umbrella receptacle (12), the other end thereof having a connecting piece (25), one end of the second bar (22) being pivoted on the connecting piece (25), the other end configured with a tad bead (3), and the second bar (22) sleeved with a first pivot connecting base (26), one end of the third bar (23) being pivoted on the second umbrella receptacle (13), the other end being pivoted on a second pivot connecting base (27) sleeved on the first bar (21), and the third bar (23) having a third pivot connecting base (28) sleeved thereon, a movable pivot connecting base (29) and a positioning piece (291) to limit the movable pivot connecting base (29), one end of the fourth bar (24) being pivoted on the movable pivot connecting base (29), the other end is pivoted on the first pivot connecting base (26), and the fourth bar (24) having a guiding piece (4) disposed thereon and connected with the connecting piece (25), the guiding piece (4) and the first bar (21) having a flexible spring (5) disposed and configured to connect therebetween.

2. The rib structure of the inverse folding umbrella according to claim 1, wherein the umbrella pole assembly (1) further comprises a third umbrella receptacle (14) sleeved on the umbrella pole (11), the third umbrella receptacle (14) and the second umbrella receptacle (13) having a spring (6) disposed therebetween, a top end of the spring (6) pushing against a bottom of the second umbrella receptacle (13), and a bottom end pushing against a top of the third umbrella receptacle (14).

3. The rib structure of the inverse folding umbrella according to claim 2, wherein the umbrella rib components (2) farther comprises a fifth bar (7), one end of the fifth bar (7) being connected on the third umbrella receptacle (14), and the other end being connected on the third pivot connecting base (28).

4. The rib structure of the inverse folding umbrella according to claim 2, wherein the third umbrella receptacle (14) has threads (141) arranged on an external surface thereof, and the third umbrella receptacle (14) further comprises a threaded cap (8) compatible with the threads (141).

5. The rib structure of the inverse folding umbrella according to claim 1, wherein the tail bead (3) further comprises a first fixing piece (31) connected to one end of the second bar (22), and a second fixing piece (32) connected to the first fixing piece (31).

6. The rib structure of the inverse folding umbrella according to claim 5, wherein the first fixing piece (31) is further configured with an intersecting hole (311) disposed at one side thereof.

7. The rib structure of the inverse folding umbrella according to claim 5, wherein the second fixing piece (32) is further configured with a through hole (321) disposed at one side thereof.

* * * * *